United States Patent [19]

Van Der Borght

[11] Patent Number: 4,624,319

[45] Date of Patent: Nov. 25, 1986

[54] METHOD AND APPARATUS TO IMPROVE WELL WATER QUALITY

[75] Inventor: Jacques A. Van Der Borght, 29, Rue du long Chêne, B-1970, Wezembeek-Oppem, Belgium

[73] Assignee: Jacques A. Van Der Borght, Wezembeek-Oppem, Belgium

[21] Appl. No.: 682,769

[22] Filed: Dec. 18, 1984

[51] Int. Cl.[4] ..... E21B 43/08; B01D 23/06; B01D 29/00

[52] U.S. Cl. ..... 166/369; 166/105.1; 166/227; 210/416.3

[58] Field of Search ..... 166/369, 276, 105.1, 166/227, 228, 233; 210/416.1, 416.3, 299, 308, 460; 138/41

[56] References Cited

U.S. PATENT DOCUMENTS

| | | | |
|---|---|---|---|
| 1,329,171 | 1/1920 | Garry | 166/105.1 |
| 1,397,836 | 11/1921 | Karns | 166/105.1 |
| 1,588,520 | 6/1926 | Trahan et al. . | |
| 2,257,344 | 9/1941 | Maloney . | |
| 2,357,589 | 9/1944 | Holmes . | |
| 2,622,683 | 12/1952 | Silitch et al. . | |
| 2,696,264 | 12/1954 | Colmerauer et al. . | |
| 2,837,032 | 6/1958 | Horsting, Sr. | 166/227 |
| 2,973,814 | 3/1961 | Adams et al. . | |
| 3,177,945 | 4/1965 | Fether | 166/227 |
| 3,280,911 | 10/1966 | Strange et al. . | |
| 3,357,564 | 12/1967 | Medford, Jr. et al. . | |
| 3,425,490 | 2/1969 | Clayton . | |
| 3,683,056 | 8/1972 | Brandt et al. | 264/112 |
| 4,014,387 | 3/1977 | Fink | 166/314 |

*Primary Examiner*—Stephen J. Novosad
*Assistant Examiner*—Bruce M. Kisliuk
*Attorney, Agent, or Firm*—Woodcock Washburn Kurtz Mackiewicz & Norris

[57] ABSTRACT

A suction control tail for use with the water pump to restrict water velocities in a well hole and thereby prevent the instrusion of sand is provided by a two-layer suction control element, or such an element in combination with a single-layer suction control element. Each of the two elements has a porous, permeable sidewall, is open at the bottom to admit water and any suspended sand particles, and is open at the top to hydraulically couple the element to a pump inlet or to the base of another element. The two-layered element is formed by a relatively rigid PVC tube with a multiplicity of opening therethrough and an outer porous, permeable layer over the openings formed by bonded granular PVC particles, the single layer element is formed by a similar, relatively rigid PVC tube having a multiplicity of uniform openings therethrough of diminishing cross-sectional area so as to control water velocities into the element.

19 Claims, 6 Drawing Figures

METHOD AND APPARATUS TO IMPROVE WELL WATER QUALITY

FIELD OF THE INVENTION

The invention relates to well water pumping methods and apparatus and, in particular, to methods and apparatus for minimizing sand intrusion into the well and therefore sand content in the pumped water.

Pumps drawing water from wells sunk in strata containing sand may be subject to very great wear because of the erosive action of the sand. Excessive sand content may also render the water unfit for its ultimate use without additional filtering.

Sand intrusion arises from a number of factors. Suction forces particularly in the vicinity of the pump inlet are primarily responsible for drawing the sand from the strata surrounding the borehole. In a vertical borehole, water generally floods into the hole through a well screen with a horizontal velocity. In the borehole, the water is subjected to precipitous vertical movement by the pump suction forces. The pump may subject the inflooding water to sufficient vertical velocities as to create a column of vertically moving water within the well screen which prevents the admission of additional water, in effect constricting the well screen in localized areas. On those areas in which the well screen is not constricted, water passes from the strata through the well screen at velocities much in excess of the velocity it would ordinarily have had if allowed to simply permeate into the borehole without the action of the pump. This relatively high velocity water movement from the strata through the well screen creates turbulences which causes many problems that accelerate the deterioration of water wells including cavern developments in the surrounding strata and gravel screen, release of oxygen, sand deposits in the borehole, high sand content in the water output, etc. Eventually, erosion of the strata surrounding the pump inlet or inlets can cause a partial collapse of the borehole in the vicinity of the pump, the collapse of overlying strata or both. Even without a catastrophic collapse of the sidewall of the borehole, enough sand may be drawn into and collect at the bottom of the borehole as to eventually fill the hole and clog the pump inlet.

U.S. Pat. No. 4,014,387 describes a control system for use in a water well which distributes suction forces generated at a suction pump inlet along a significant length of the well screen and reduces the suction forces at the well screen to low levels so as to prevent the movement of sand grains into the borehole from the strata under the action of the pump. The suction control system of the patent consists of one or more identical tubular elements each consisting of a pair of concentric, rigid cylinders with numerous, small, uniformly sized, shaped and distributed openings therethrough and an intermediate layer of a rigid granular material filling the space between the cylinders. The granules are simply packed loose between the cylinders but, alternatively, may be consolidated into a separate, permeable cylindrical tube. The permeability of the sidewall of each tubular element is substantially uniform around the circumference and along the length of the element. The system of the patent is closed at its lower end causing water to be drawn through only the sidewalls of the individual elements. A sufficient number of elements are supplied to provide a permeable surface of sufficient area and length to reduce the rate of flow of water through the walls of the elements to that of the natural flow rate of water in the strata. This is below a rate sufficient to overcome the inertia of sand in the strata.

One problem of the suction control system described in the patent is that while the patent significantly reduces the intrusion of sand into the borehole, it does not prevent such movement entirely. Specifically, with the system of the patent, sand intrusion tends to increase over time as the system is used in the field. It has been suggested that pumps used with the system described in the patent be started slowly to allow a suction force to be built up gradually in the system. In practice, users often start pumps at full capacity which, it has been found, causes sand to be drawn into the borehole and into the system. Sand drawn into the system may be trapped between the rigid cylinders and permeable layer clogging the layer or, to some extent, drawn into the hollow interior of the system. As the bottom of the system is closed, the reduction of permeable surface area from sand clogging increases the suction forces and water flow rates through the remaining permeable areas of the sidewalls of the system elements. Also, sand suspended between the cylinders or within the body during operation of the pump will tend to drop to the bottom of the body or bottom of the concentric cylinders of the element when the pump is turned off clogging the bottoms of both the system and sidewalls of the individual elements. The removal of the system from the well and the reconditioning of the individual elements to remove trapped sand are very expensive and the principal drawbacks of that patented invention.

OBJECTS OF THE INVENTION

It is a principal object of this invention to provide a new apparatus and method for drawing sand-free water from wells drilled in sandy, water-bearing strata.

It is another object of the present invention to provide such a method and apparatus which is simple in construction, reliable in operation and relatively inexpensive to manufacture and install.

It is yet another object of the invention to provide a method and apparatus for more uniformly distributing pump forces along the length of the wall itself.

It is yet another object of the invention to provide a suction control system utilizing elements of different permeability to differentially control water flow rates into the system.

SUMMARY OF THE INVENTION

One aspect of the invention is a pair of suction control elements of improved construction and performance. A primary suction control element, used under all sand conditions, is tubular and has a sidewall surrounding a hollow interior and defining a pair of open ends of the element. The sidewall is permeable along the major portion of its length and is multi-layered, having a relatively rigid inner layer formed by a tube with a rigidity sufficient to absorb fluid impact loads arising from switching on and off a connected water pump and an outer, granular layer which is directly exposed to water in the well. The tube forming the interior layer of the element sidewall is made porous and permeable by the provision of a multiplicity of openings therethrough uniformly distributed about its circumference and along substantially all of its length beneath the outer, granular layer. The granular layer is also porous and permeable and is formed by particles bonded to one another and to the outer surface of the tube. A collar is provided at one end of the element for coupling the element to a pump flange, adaptor or other element.

A second suction control element is provided for use with the first element. This second element, like the first, is tubular and has a sidewall surrounding a hollow interior and defining a pair of open ends of the element. The major portion of the sidewall is again provided by a relatively rigid tube (i.e., a tube with a rigidity sufficient to absorb fluid impact loads encountered during operation), the exposed surfaces of the tube forming portions of the outer and inner surfaces of the sidewall of the element. The second element also includes a collar at one of the open ends thereof or other means suitable for mechanically and hydraulically coupling that open end with an open end of another suction control element so as to form a multi-element suction tail. The sidewall is provided with a multiplicity of openings therethrough which are uniformly distributed both around the circumference and along substantially the length of the element. The openings have a noticeably greater open cross-sectional area on the outer surface of the tube than on the inner surface so as to maintain a laminar flow of water into the element.

Another aspect of the present invention is the suction control tail formed by combining the improved elements of the invention. The tail has a porous, permeable, tubular sidewall surrounding a hollow interior and is unrestrictly open at its lower end to water in the well and to any sand the water may carry. The upper end of the tail is adapted for mechanical and hydraulic coupling with the inlet of a suitable pump. By means of the pump, water is drawn into the inlet through the permeable sidewall and the open lower end of the tail. The tail is provided with a permeable surface area, the length and permeability of which is such that the rate of flow of water into the well at each point about the tail and pump inlet, while the pump is in operation at maximum capacity, is less than a rate of flow necessary to overcome inertia of sand in the strata surrounding the well. In particular, the rate of flow of water into the well bore with the pump and suction control tail in operation is about 10 mm/sec. or less. Thus water flows from the strata into the well hole essentially sand free.

According to the invention, the outer layer of the first element has an open porosity of less than approximately 30%. Preferably too, the granular particles have uniform sizes of between about 0.8 and 1.2 millimeters and applied in a layer of between 10 and 15 millimeters in thickness to provide an effective permeability to water of between about 3 and 8 cubic meters per hour per meter ("$m^3/h/m$"). Unless otherwise noted, the permeabilities hereinafter referred to are relative permeabilities measured under normal load conditions imposed by an associated pump in the configuration used.

Another aspect of the invention is an improved method of pumping water from a well so as to minimize or prevent the intake of sand from the surrounding strata and is accomplished by hydraulically coupling to the intake of a water pump a suction control tail having a sidewall extending away from the pump inlet with a differing permeability along its length, the absolute permeability (i.e., the permeability under *identical* suction load conditions at each point where permeability is measured) being lower proximal to the pump inlet and higher distal to the pump inlet; completely submerging the tail in the well beneath the water level; and drawing water by means of the pump through the sidewall of the tail at velocities less than a velocity necessary to remove sand from the strata surrounding the well whereby water is withdrawn by the pump essentially sand free.

Also according to the invention, an improved method of pumping water from a well sunk in sandy, water-bearing strata comprises hydraulically coupling to the inlet of a pump one end of a suction control tail having a permeable sidewall defining an opposing, open end unrestrictly admitting water and any suspended sand particles into the tail; completely submerging the suction control tail in the well beneath the level of water; and drawing water from the well by means of the pump through only the permeable sidewall and lower open end of the suction control tail at velocities less than a velocity necessary to remove sand from the strata surrounding the well hole whereby the water is withdrawn from the well essentially sand free.

In each of these methods, water is drawn into the tail at velocities of about 10 mm/sec. or less at all points where water is admitted into the tail.

BRIEF DESCRIPTION OF THE DRAWINGS

Other objects, advantages and features of the present invention will be apparent from the accompanying description and figures wherein.

DETAILED DESCRIPTION OF THE INVENTION

Figure 1:
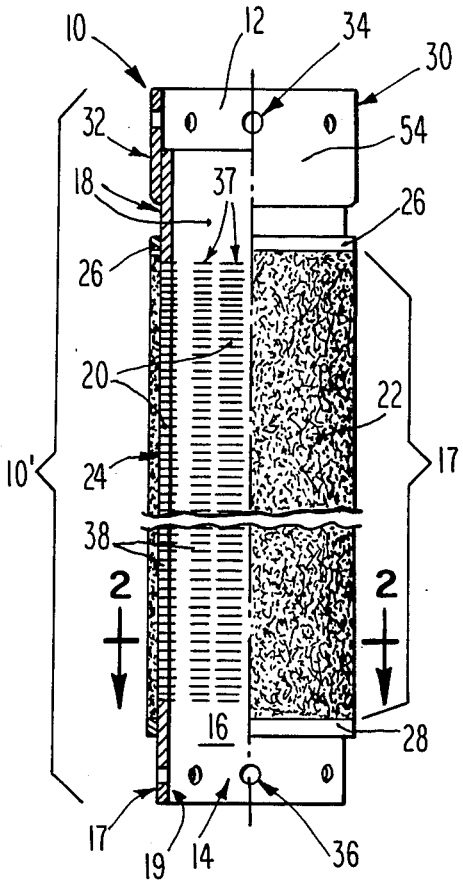
FIG. 1 is a sideview, in partial cross-section, of an exemplary first multilayer control element for a suction control tail of the present invention.
Figure 2:
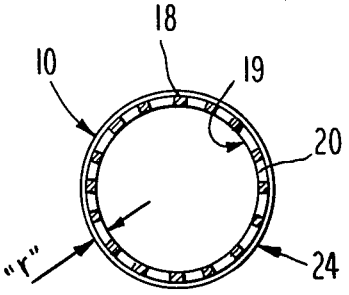
FIG. 2 is a cross-section of the element of FIG. 1 along the lines 2—2.

FIGS. 1 and 2 depict an exemplary multi-layer suction control element 10 of the subject invention. The element 10 is tubular in form, has a sidewall 10' defining an open upper end 12 and an open bottom end 14 and surrounding a hollow interior 16. The side wall 10' is formed, in part, by a length of polyvinylchloride (PVC) tubing 18 or other tubular materials of sufficient rigidity and strength as to be able to withstand the forces, particularly fluid impact forces to which the element is subjected during use. Preferably, as much of the length of the tube 18 as is possible is provided with openings 20 which extend transversely through the tube 18 between its outer to inner surfaces 17 and 19. The openings 20 are preferably uniformly sized, shaped and spaced so as to uniformly distribute suction forces and water flow around the circumference and along the length of the tube. The element 10 has a porous outer surface 22 exposed to water in the wall which is provided by a layer 24 of polyvinylchloride or other rigid, granular particles bonded to one another and, preferably, to the outer surface 17 of the tube 18 so as to form a continuous, porous and permeable layer about the outer surface 17 of the tube 18 covering the area of the openings 20. A pair of PVC bands 26 and 28 are attached to the outer surface 17 of the tube 18 at either end of the layer 24 by adhesives or other suitable means. The bands 26 and 28 have a radial thickness at least equal to the maximum radial thickness of the layer 24 so as to provide protection for the layer. The remainder of the sidewall of the tube 10 is formed by a mating collar 30 that is provided at the upper end of the element 10 for attaching the element to the lower end of an identical element, a suitably configured pump flange or an adaptor for hydraulically coupling the element 10 with the inlet of a water pump (none depicted). The collar 30 is formed by a short length of polyvinylchloride tubing 32 having an inner diameter approximately equal to or slightly larger than the outer diameter of the tube 18. The collar 30 is secured to the tube 18 by a suitable means such as an adhesive and/or other suitable sealing and/or securing means. A number of bores 34 are provided around the upper end of the collar 30. The bores 34 may be threaded to accept screws. Similar openings 36 are similarly provided at the lower end of the tube 18 for coupling. Other conventional mechanical pipe coupling structures, such as threads, may instead be provided at either or both ends of the element.

The permeability of the element to water is substantially, if not essentially controlled by that of layer 24 and is less than about 10 $m^3/h/m$ and is preferably between about 3 and 8 $m^3/h/m$. The openings 20 in the tube 18 are horizontal slots preferably packed as closely as possible to minimize flow resistance and are sufficiently narrow to prevent collapse of the overlaying layer 24 and of the element itself. Slots about 25 mm (1 inch) or more in length about the circumference of the tube 18 and about 0.5–0.8 mm (0.02–0.03 inches) in height and having practically the same open cross-sectional area at the outer 17 and inner 19 surfaces of the tube 18 are suggested. The openings 20 are provided in a density of approximately 300 to 800 openings per square meter $m^2$ (25 to 75 openings/$ft^2$). The openings 20 are depicted as being arranged in parallel columns 37 along the length and around the circumference of the tube but other arrangements are possible.

The polyvinylchloride granules forming the layer 24 are sieved clean and are sized between 0.8 and 1.2 mm (about 0.03 to 0.045 inches). The cleaned, sized granules are combined with a suitable waterproof adhesive such as waterproof rated epoxy resin and are applied in a uniform layer having a uniform thickness "r" (see FIG. 2) of between about 10 and 15 mm (0.4 and 0.6 inches) thick to the outer surface 17 of the tube 18 and cured by a method appropriate for the adhesive selected. Preferably too, the PVC tube outer surface is cleaned of contaminents and roughened to provide better adhesion. Granules and adhesive are provided in relative weight proportions of very approximately 80% granules and 20% adhesive and applied in the indicated uniform thickness of about 10–15 mm to yield a layer having the desired operating permeability to water of about 3 to 8 $m^3/h/m$.

FIG. 2 shows the uniform size, shape, cross-sectional area and distribution of the openings 20 through and around the tube 18 as well as the uniform radial thickness "r" of the layer 24 covering the outer surface 17 and openings 20.

Figure 3:
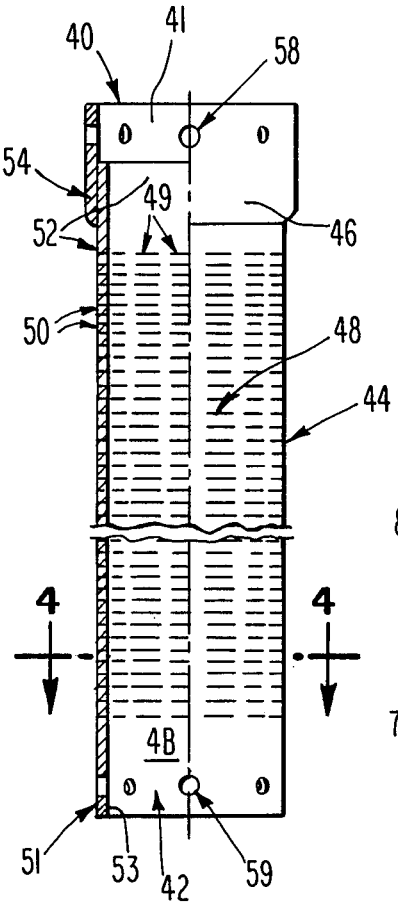
FIG. 3 is a sideview in partial cross-section of an exemplary second single layer control element for a suction control tail of the present invention.

FIG. 3 depicts a second suction control tail element 40 for use in combination with the element 10 of FIG. 1 when it is necessary or desirable to spread the suction force of a pump along a greater length of the well screen. Like the element 10, the element 40 has a sidewall 44 defining an open upper end 41 and an open lower end 42 and surrounding a hollow interior 43. The sidewall 44 is formed, in part, by a length of polyvinylchloride tubing 52 with a second, shorter length 54 sealingly bonded at the upper end of the tubing 52 so as to form a coupling collar 46. The element 40 is made porous and permeable along as much of its length as is possible by the provision of a large number of openings 48, through the wall of the tube 52. Again, the openings 48 are uniformly sized, shaped and spaced slots 48. As is better seen in FIG. 4., the slots 48 in element 40, unlike the slots 20 in the element 10, preferably have a distinctly larger cross-sectional area at the outer surface 51, than at the inner surface 53 of the tube 52, to prevent turbulance and create a laminar flow of water accelerating through the openings into the tube 40. Since this element lacks an outer granular layer to control water velocities into the element, the slot system must be constructed so as to provide as low a resistance to water flow as possible. A slot opening 48 is depicted in FIG. 5. The opening is elongated in form and has a major axis 100 of about 77 mm. or less in length and a minor axis 101 of about 0.8 mm. or less in height forming an opening area of about 61.6 $mm^2$ or less, on the outer surface 51 of the tube. On the inner tube surface, the dimensions of the major axis 100 and minor axis 101 of the openings are about 60 mm. or less and 0.8 mm. or less, respectively, providing an opening area of about 48 $mm^2$ or less.

Figure 4:
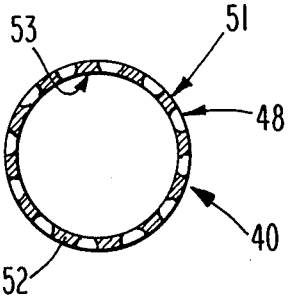
FIG. 4 is a cross-section of the element of FIG. 3 along the lines 4—4.
Figure 5:
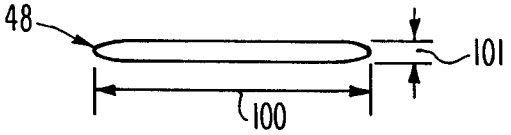
FIG. 5 depicts the form of the openings in the sidewall of the second element.

Referring to FIGS. 3 and 4, the slot openings 48 are preferably arranged in parallel columns 49 along the length of the tube 52 and uniformly spaced around its circumference. A number of bores 58 and 59 are again provided in the upper portion of the collar 46 and at the lower extremity of the tube 52, respectively, for coupling the element 40 with another element 10 or 40 or for attaching ancillary tail equipment to element 40 as will be later described.

Because the suction control element 40 is intended to be used at the end of one or more multi-layer elements 10 and remote from the pump inlet, the absolute permeability of the sidewall 44 is greater than the absolute permeability of the multi-layer element 10 through its layer 24 and openings 20 under identical suction load conditions. It has been found that such as arrangement aids in maintaining water velocity to a point at which virually no sand is drawn into the interior of the suction control tail.

Figure 6:
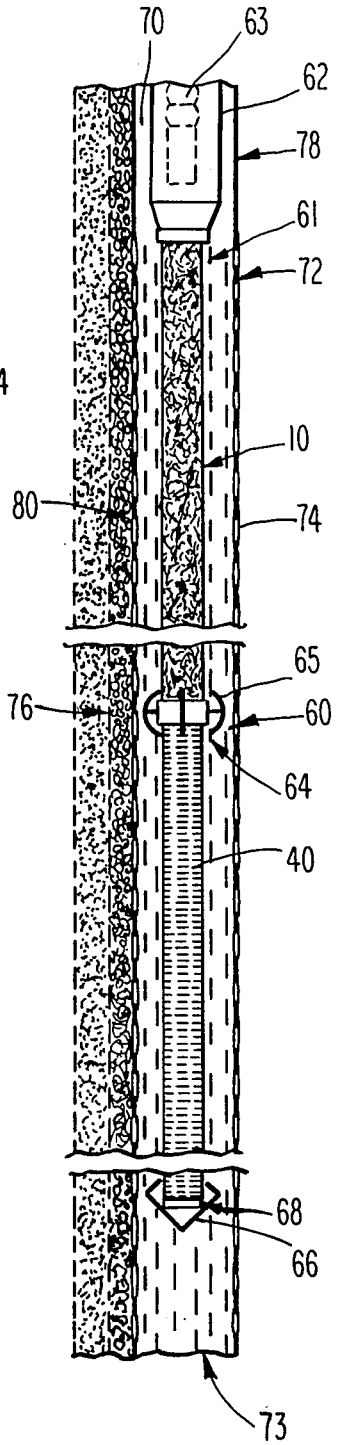
FIG. 6 depicts the exemplary bodies of the previous figures combined in a single suction control tail positioned in a well bore for use with a submersible pump.

FIG. 6 depicts in an exemplary fashion the use of the elements 10 and 40 to construct a multi-element suction control tail 60. The upper element 10 of the tail 60 is mechanically and hydraulically coupled at its open upper end to a submersible pump 63, indicated in phantom, by a pressure casing adaptor 62 partially depicted. The casing adaptor 62 sealingly surrounds the submersible pump 63 and is mechanically coupled with the pump in an associated main rising (not depicted) to support the tail 60 in the well. The casing adaptor 62 provides a hydraulic coupling between the pump inlet and the hollow interior of the tail 60 through the upper open end 12 of first element 10. Alternatively, the tail can be hydraulically coupled with the intake of a shaft driven pump or suction tube. In this application, the element 40 more distant from the pump inlet, will exhibit an operating permeability lower than that exhibited by the element 10.

The tail 60 is submerged beneath the water in a well hole 70 to a sufficient depth so as to always be beneath the operational water level, or "OWL" of the well. A well screen is provided by joined lengths of perforated pipe or tubing 72. Perforations 74 are provided in the tubing 72 along the height of the surrounding, water bearing strata 76 to permit water in the strata 76 to enter the well hole 70. Lengths of unperforated pipe or tubing 78 are typically provided above the perforated pipe 72 to prevent contaminents from entering the well. Typically too, the well screen 72 is also surrounded by a gravel pack 80 which provide a primary or initial sand screening function. However, the gravel pack 80 has a poor sand filtering ability and is unable to prevent the intrusion of sand from the surrounding strata 76 into the well hole 70 during conventional pumping operations without the assistance of a suction tail.

The tail 60 is further equipped with centering guides 64 joined to a collar 65 screwed or bolted through the bores 36 and 58, which are also used to join the elements 10 and 40. The centering guides 64 center the tail in the borehole so that pump suction forces are equalized about the well screen. A base piece 66 is also attached to the lower end of the element 40 by means of a collar 68 screwed or bolted through the openings 59 at the lower end of the element 40 to protect the base of the tail 60 and to prevent the lower open end of the element 40 from being accidentally damaged when being introduced into the borehole.

One skilled in the art will appreciate that elements 10 and 40 can be combined in various numbers so as to control water intake velocities in the well hole to about 10 mm./sec. or less for various pump capacities. As an example of the operation of the invention, consider a borehole 70 having an inner diameter of about 33 mm (12 inches) and submersible pump applying a suction load at its inlet for drawing water at an operating rate of about 35 liters per second or "LPS" (about 555 gallons per minute or "gpm"). Under these conditions, the suction force of the pump is sufficiently strong to move sand for a distance of about 15 to 25 feet from the inlet of the pump. A suction control tail formed by a single, multi-layer element 10 of the aforesaid type having an outer diameter of about 150 mms (about 16 inches) and a permeable area length of about 5 meters (16 feet) provides a water flow of about 6.6 LPS (about 105 gpm) per meter of permeable tube length and of about 2 LPS (about 32 gpm) through the open bottom 16 for a total capacity of about 35 LPS (555 gpm). The tail formed by the single element 10 under these conditions generates a water velocity of about 10 mm/sec. or less at the well screen, of about 10 mm/sec or less at about 25 mm (1 inch) from the permeable wall of the multi-layer element 10 and of about 4 (four) mm/sec. or less at the open bottom of the element. This, of course, assumes that the well screen has a permeable area sufficiently large to supply water at a natural flow rate in excess of the 555 gpm capacity of the pump. Such an arrangement would be suitable for well holes sunk in strata containing fine sand (i.e., sand formed by grains having average particle sizes of between about 0.4 mm and 1.5 mm) with some soil or clay and essentially free of very fine sand (i.e., particle sizes of 0.4 mm or less).

In the extreme case of a well sunk in a strata containing significant amounts of very fine grain sand (typically, particle sizes of 0.2 to 0.4 mm and 1.5 specific gravity) and essentially free from soil or clay, a second element 40 with a permeable length of at least about 2 m (6 ft.) and preferably 3 m (10 ft.) is required at the base of element 10, as depicted in FIG. 5, to preclude sand invasion. The tail formed by a 5 m long two-layer element 10 and a 2–3 m long single layer element 40 and operating with the aforesaid pump having a 35 LPS operating rate reduces the maximum water velocity to about 10 mm per second or less at the well screen, to about 10 mm per second or less at about 25 mm (1 inch) from the permeable wall of the upper element 10, to about 7 mm/sec. or less at about 25 mm (1 inch) from the permeable wall of the lower element 40 and to about 4 mm/sec. or less at the lower open end of the tail.

The recited embodiments and operating examples are exemplary only in improvements thereto and variations thereon may be apparent to one skilled in the art. Accordingly, such modifications fall within the scope of the invention as defined by the appending claims.

What is claimed is:

1. An apparatus for drawing water essentially free of sand from a well hole sunk in a sandy, water-bearing strata comprising:

a tubular suction control tail submerged in the water within the well hole and having a sidewall permeable to water along a major proportion of its length, an opening at the lower end of the tail to admit water and any sand suspended in the water into the tail and a hollow interior hydraulically coupled with water in the well hole through the permeable sidewall and through the opening;

pump means having an inlet hydraulically coupled with the hollow interior of the tail through an opening at the upper end of the tail and imposing suction through the inlet on the tail for drawing water at an operating rate through the permeable sidewall, the lower end opening and hollow interior of the tail; and the suction control tail sidewall being of sufficiently large permeable area, sufficient length and sufficiently low permeability so that the rate of flow of water into the tail at each point along the permeable sidewall and at the lower open end under the operating rate suction of the pump means is less than a rate of flow necessary to overcome inertia of sand in the adjoining strata such that water flows into the tail essentially sand free.

2. The apparatus of claim 1 wherein the suction control tail comprises:

a first tubular element having a hollow interior hydraulically coupled with the pump inlet through an upper open end of the element, a lower end opening permitting unrestricted flow of water and any suspended sand particles present in the water into the hollow interior and a sidewall having an inner member formed by a rigid material with a multiplicity of openings therethrough and a porous permeable, granular outer layer overlying the openings, directly exposed to the water in the well.

3. The apparatus of claim 2 wherein the first element further comprises:

a pair of annular bands around the element at either end of the layer each having a minimum radial thickness at least equal to the maximum radial thickness of said layer.

4. The apparatus of claim 2 wherein said suction control tail further comprises:

a second tubular element mechanically coupled with the lower end of the first element and having a sidewall with an outer surface exposed to the water in the hole and an inner surface defining a hollow interior of the element, a multiplicity of uniform openings extending completely through the sidewall from the outer surface to the inner surface and distributed over a major proportion of the sidewall area, an open lower end unrestrictly admitting water and any suspended sand particles into the hollow interior of the second element, and an open upper end hydraulically coupling the hollow interior, open lower end and sidewall of the second element with the lower open end of the first element.

5. The apparatus of claim 5 wherein the openings through the sidewall of the second element have a greater open cross-sectional area on the outer surface of the sidewall than on the inner surface of said sidewall.

6. The apparatus of claim 1 wherein the permeability of said major proportion of the sidewall is about 10 $m^3/h/m$ or less under said operating rate of the pump means.

7. An apparatus for drawing water essentially free of sand from a well hole sunk in a sandy, water-bearing strata comprising:

a tubular suction control tail positioned submerged beneath the level of water within the well hole having a porous, permeable sidewall, an opening at the lower end of the tail admitting water and any sand particles suspended in the water into the tail and a hollow interior hydraulically coupled with water in the well hole through the sidewall and lower end opening;

pump means having an inlet hydraulically coupled with the hollow interior of the tail through an opening at the upper end of the tail for drawing water from the well hole through the permeable sidewall, lower end opening and the hollow interior of the tail;

the sidewall comprising an inner, rigid tubular member with an outer surface, an inner surface and a multiplicity of openings therethrough and an outer layer of granular particles bonded together in a porous, permeable layer against the outer surface of the rigid member over the openings; and the sidewall having a porous, permeable area sufficiently large and of sufficient length and sufficiently low permeability whereby, under the normal operating rate of the pump means, the rate of flow of water into the tail at each point along the permeable sidewall and at the lower open end is less than a rate of flow necessary to overcome inertia of sand in the adjoining strata.

8. The apparatus of claim 7 wherein the layer has an average permeability to water of between about 3 and 8 $m^3/h/m$.

9. The apparatus of claim 7 wherein said layer has an open porosity of about 30% or less.

10. The apparatus of claim 9 wherein the granular particles have uniform sizes of between about 0.8 and 1.2 mm.

11. The apparatus of claim 10 wherein said layer is between about 10 and 15 mm in thickness.

12. The apparatus of claim 11 wherein each of said openings has a surface area of about 70 $mm^2$ inches or less at the inner surface of the element.

13. The apparatus of claim 12 wherein the openings are provided with a density of about 800 openings per $m^2$ or less.

14. The apparatus of claim 11 wherein said openings are slots about 25 mm or more in length and about 0.8 mm or less in height.

15. An apparatus for drawing water essentially free of sand from a well hole sunk in a sandy, water-bearing strata comprising:

a pump having an inlet submerged beneath the water in the well hole;

a hollow, tubular suction control tail positioned beneath the pump inlet within the well hole and having a hollow interior hydraulically coupled with the pump inlet through an upper end opening, an open lower end admitting water and any suspended sand particles in the water into the interior of the tail and a porous sidewall having an absolute permeability in a portion of its length proximal the pump inlet lower than an absolute permeability in a portion of its length proximal the lower end opening of the tail.

16. An improved method for drawing water essentially free of sand from a well hole sunk in a sandy, water-bearing strata comprising the steps of:

centrally positioning in the well hole submerged beneath the water a suction control tail having a hollow interior hydraulically coupled at an upper end of the tail to an inlet of a pump, an opposing lower end open between the hollow interior and the interior of the well hole and a tubular sidewall permeable to water along a major proportion of its length; and drawing water into the inlet by means of the pump through only the permeable sidewall and lower open end of the tail and at velocities less than a velocity necessary to remove sand from the strata surrounding the well hole, whereby the water is withdrawn from the well essentially sand free.

17. The improved method of claim 16 wherein said step of drawing water into the tail further comprises drawing water into the permeable sidewall and open lower end at velocities of about 10 mm/sec. or less.

18. An improved method of pumping water essentially free of sand from a well hole sunk in a sandy, water-bearing strata comprising the steps of:

hydraulically coupling one end of a hollow, tubular suction control tail with an inlet of a pump, the tail having a sidewall extending away from the pump inlet into the well hole and being permeable at more than one location along its length, the sidewall having a lower absolute permeability proximal to the pump inlet and a higher absolute permeability distal to the pump inlet;

centrally positioning the tail and inlet in the well hole beneath the water level; and drawing water into the tail and inlet by means of the pump through the sidewall of the tail at velocities less than a velocity necessary to remove sand from the strata surrounding the well hole whereby the water is withdrawn by the pump essentially sand free.

19. The method of claim 18 wherein said step of drawing water into the tail further comprises drawing water through the permeable sidewall locations at velocities of about 10 mm/sec or less.

* * * * *

UNITED STATES PATENT AND TRADEMARK OFFICE

CERTIFICATE OF CORRECTION

PATENT NO. : 4,624,319

DATED : November 25, 1986

INVENTOR(S) : Jacques A. Van der Borght

It is certified that error appears in the above-identified patent and that said Letters Patent is hereby corrected as shown below:

Column 2, line 44, delete "wall" and insert -- well-- therefor.

Column 4, line 61, delete "wall" and insert -- well-- therefor.

Column 6, line 44, delete "as" and insert --an-- therefor.

Column 9, line 10, delete "claim 5" and insert --claim 4-- therefor.

Signed and Sealed this

Fifteenth Day of September, 1987

*Attest:*

DONALD J. QUIGG

*Attesting Officer*

*Commissioner of Patents and Trademarks*